US006991145B1

(12) United States Patent
Ho

(10) Patent No.: US 6,991,145 B1
(45) Date of Patent: Jan. 31, 2006

(54) SYNCHRONOUS FINE TUNABLE MATERIAL FEEDING MECHANISM

(75) Inventor: Chi-Min Ho, Hua Tan Hsiang (TW)

(73) Assignee: Elite Machine and Design Ltd., Hua Tan Hsiang (TW)

( * ) Notice: Subject to any disclaimer, the term of this patent is extended or adjusted under 35 U.S.C. 154(b) by 0 days.

(21) Appl. No.: 10/945,387

(22) Filed: Sep. 20, 2004

(51) Int. Cl.
*B65H 20/02* (2006.01)

(52) U.S. Cl. ..... 226/177; 226/187

(58) Field of Classification Search ..... 226/177, 226/187, 176
See application file for complete search history.

(56) References Cited

U.S. PATENT DOCUMENTS 1,825,957 A * 10/1931 Lane ..... 72/248
2,684,001 A * 7/1954 Wilson ..... 72/10.7
3,277,856 A * 10/1966 Ricci ..... 72/419
3,493,159 A * 2/1970 Edwards et al. ..... 226/142
4,470,284 A * 9/1984 Noe et al. ..... 72/248
4,759,485 A * 7/1988 Braun et al. ..... 226/176
4,819,507 A * 4/1989 Pescher ..... 74/665 GA
5,040,429 A * 8/1991 Del Castillo ..... 74/424
5,072,872 A * 12/1991 Casset et al. ..... 226/176
5,425,530 A * 6/1995 Daurte ..... 254/89 R
5,772,095 A * 6/1998 Nordlof ..... 226/109
5,967,512 A * 10/1999 Irsik ..... 271/273
6,533,154 B2 * 3/2003 Kitai et al. ..... 226/177

FOREIGN PATENT DOCUMENTS

TW 284190 8/1996

* cited by examiner

*Primary Examiner*—Kathy Matecki
*Assistant Examiner*—Evan Langdon
(74) *Attorney, Agent, or Firm*—Alan D. Kamrath; Nikolai & Mersereau, P.A.

(57) ABSTRACT

A synchronous fine tunable material feeding mechanism includes a platform, a control member and a link device. A side panel is installed separately on both sides of the platform, and a top panel is installed on the side panels. A fixed roller and a movable roller are disposed between the two side panels. The two control members are disposed at the top panel and elastically push against the movable roller. The link device is disposed between the two control members and is capable of simultaneously driving one control member according to the movement of the other control member and to elastically push the movable roller synchronously to produce a downward force with a constant pressure.

15 Claims, 7 Drawing Sheets

3-3

SYNCHRONOUS FINE TUNABLE MATERIAL FEEDING MECHANISM

BACKGROUND OF THE INVENTION

1. Field of the Invention

The present invention relates to a material feeding mechanism and, more particularly, to a synchronous fine tunable material feeding mechanism.

2. Description of the Related Art

Taiwan Patent Publication No. 284190 entitled "Roller type metal plate feeder adjusting assembly" comprises a platform 10, an adjusting member 20, a link axle 30, an eccentric cam 40 and a rotary axle 50. An adjusting member 20 is disposed separately on both sides of the platform 10. The adjusting member 20 has a long hole 21 for allowing a screw 212 to adjust the height of the platform 10. The link axle 30 has two adjusting members 20 disposed separately on both sides of the link axle 30. The eccentric cam 40 is coupled at one end of the link axle 30 and has a handle 41 for pivotally rotating the link axle 30 and the adjusting member 20 when the handle 41 is pulled. Such arrangement changes the height of the adjusting member 20 and the rotary axle 50. The screw 212 is used to pass through the long hole 21 of the adjusting member 20 to secure the adjusting member 20 in position. Then a spring (not numbered in the publication) disposed at the internal side of the handle 41 is used to achieve the purpose of synchronously adjusting a gap.

However, the prior art structure still has many drawbacks. Specifically it is necessary to adjust the spring (not numbered in the publication) at the inner side of the handle 41 when the force for clamping the two rollers is adjusted, such that the downward force can be exerted evenly on the metal panel. Since it is difficult for the spring to control the adjustment due to a wrong number of turns or due to the operation by an inexperienced operator, the force exerted on both ends of the rollers will be uneven and the metal panel may be tilted or twisted, and thus resulting in an unsmooth operation of the material feeding process and causing troubles to the application. The aforementioned problems demand immediate attention and improvements.

SUMMARY OF THE INVENTION

In view of the foregoing shortcomings of the prior art, the present invention is intended to overcome the technical issues of requiring an adjustment of a spring at the inner side of the handle when the force for clamping the two rollers is adjusted, so that a downward force can be exerted evenly on the metal panel. Since it is difficult for the spring to control the adjustment due to a wrong number of turns or due to the operation by an inexperienced operator, the force exerted on both ends of the rollers will be uneven and the metal panel may be tilted or twisted, and thus resulting in an unsmooth operation of the material feeding process and causing troubles to the application.

Therefore, it is the primary objective of the present invention to provide a synchronous fine tunable material feeding mechanism, which comprises a platform, a control member and a link device. A side panel is installed separately on both sides of the platform, and a top panel is installed on the side panels A fixed roller and a movable roller are disposed between the two side panels. Two control members are disposed at the top panel and elastically push against the movable roller. The link device is disposed between the two control members and is capable of simultaneously driving another control member according to the movement of a control member and elastically pushing the movable roller synchronously to produce a downward force with a constant pressure. As a result, an even force is exerted on the work piece clamped between the movable roller and the fixed roller, which is a novel improved design.

BRIEF DESCRIPTION OF THE DRAWINGS

The above objectives, features and advantages of the present invention will become apparent from the following detailed description taken with the accompanying drawings. However, these drawings are provided for reference and illustration and not intended to act as a limitation to the present invention.

DETAILED DESCRIPTION OF THE PREFERRED EMBODIMENTS

Figure 1:
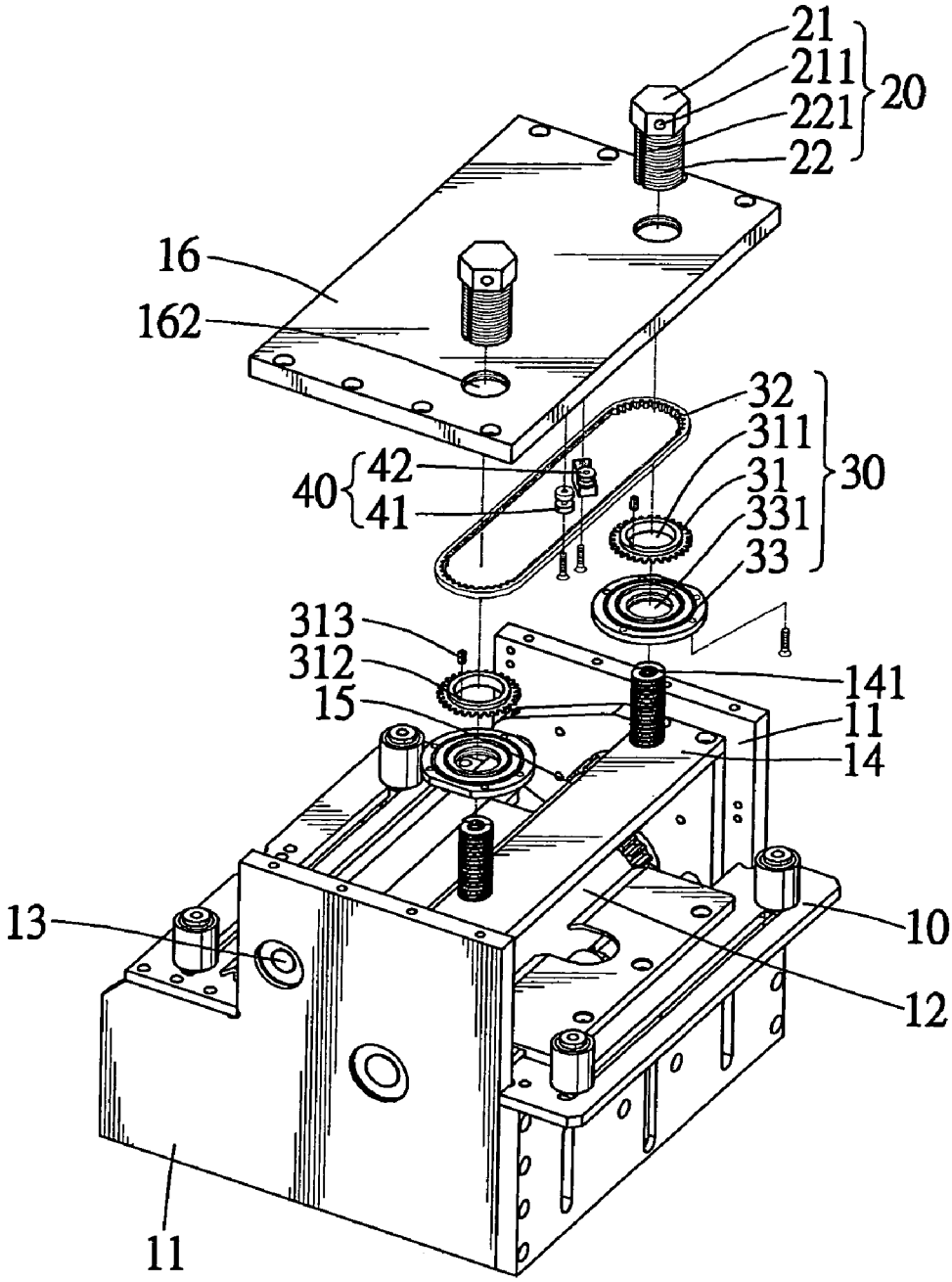
FIG. 1 is an exploded view of the synchronous fine tunable material feeding mechanism according to the present invention.
Figure 2:
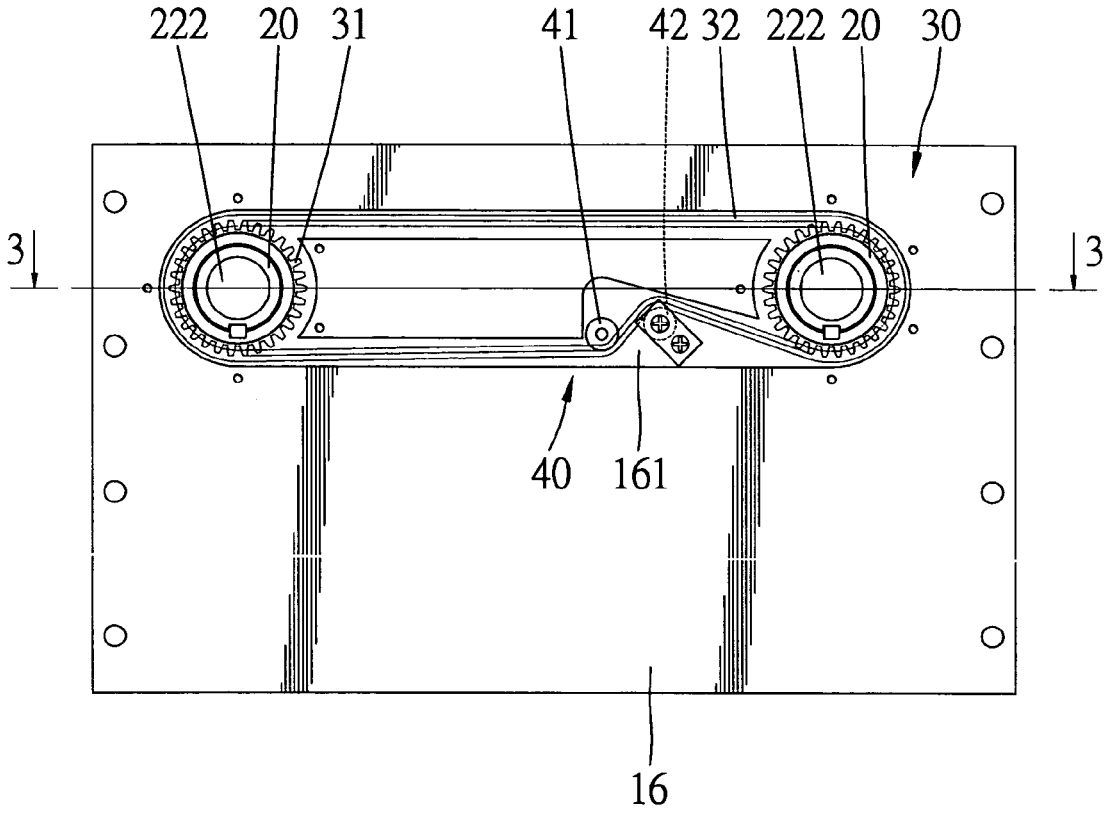
FIG. 2 is an illustrative view of the link device using a gear to simultaneously synchronize with the movement of a synchronous belt according to a first preferred embodiment the present invention.

Referring to FIGS. 1 and 2, synchronous fine tunable material feeding mechanism according to a first preferred embodiment of the present invention comprises a platform 10, a link device 30 and a strain device 40. The platform 10 comprises two control members 20, and each control member 20 can elastically push against a movable roller 15. The link device 30 is disposed between the two control members 20 and is capable of driving one of the two control members 20 to move according to the movement of another one of the two control members 20 so the two control members 20 act synchronously at the movable roller 15. The strain device 40 is installed onto the link device 30 to assure the synchronous movement of the link device 30.

The platform 10 comprises a side panel 11 disposed separately on both sides of the platform 10. A fixed roller 12 and a pivotal axle 13 are disposed between the two side panels 11. A movable stand 14 is installed onto the pivotal axle 13, and the movable stand 14 uses the pivotal axle 13 as the center of rotation and produces a swinging relation with respect to the side panels 11. The movable stand 14 comprises the movable roller 15 being pivotally disposed therein and parallel to the fixed roller 12, such that the movable roller 15 can generate a change to a gap between the swing of the movable roller 15 and the fixed roller 12. The movable stand 14 has a spring 141 installed separately on both ends of the top of the movable stand 14. The two side panels 11 also install a top panel 16, and an accommodating space 161 is disposed on one side of the top panel 16. A through hole 162 is disposed on each of both sides of the accommodating space 161, and the through hole 162 has a thread therein.

The control member 20 passes into the through hole 162 of the top panel 16 and also couples to the spring 141 of the movable stand 14. The control members 20 are pressed by the spring 141 to move the movable stand 14 downward, so that the movable roller 15 pivotally coupled in the movable stand 14 presses on the fixed roller 12. The control members 20 pass through the two through holes 162 of the top panel 16 according to this embodiment. The control member 20 comprises an adjusting end 21 and a threaded end 22. The adjusting end 21 according to this embodiment is a hexagonal adjusting end 21 having a penetrating hole 211 disposed on one side for allowing users to pull the adjusting end 21 by a tool. When the threaded end 22 passes through the through hole 162 of the top panel 16, a spiral movement is produced according to the thread inside the through hole 162. A groove 221 is disposed at the external periphery of the threaded end 22 and is parallel to the axis. The threaded end 22 forms a hollow sink hole 222 therein. The sink hole 222 can accommodate the spring 141 in contact with the movable stand 14. When the control member 20 is rotated, the threaded end 22 of the control member 20 performs a spiral movement to produce a slight axial gain and presses the spring 141 to push the movable stand 14 in order to achieve the purpose of fine tuning the movable roller 15 to press the fixed roller 12 downward.

The link device 30 is installed in the accommodating space 161 of the top panel 16 and coupled between the two control members 20. The link device 30 comprises two active components 31, a passive component 32 and two bases 33. The two active components 31 are coupled to the threaded ends 22 of the two control members 20, respectively. The active component 31 has a through hole 311, and a key slot 312 is disposed above the through hole 311. A key 313 is installed between the key slot 312 and a groove 221 of the threaded end 22 for driving each other. The active component 31 according to this embodiment is a gear, and the passive component 32 according to this embodiment is a synchronous belt installed between the two gears. The passive component 32 can effectively drive the active components 31 to rotate. The two bases 33 are secured, respectively, to both ends of the accommodating space 161 of the top panel 16 for fixing both active components 31 at appropriate positions. The base 33 comprises a through hole 331 having a thread therein for passage of the threaded end 22 of the control member 20. When the link device 30 is driven to rotate one control member 20, the other control member 20 is linked to achieve the synchronization effect.

The strain device 40 is installed in the accommodating space 161 of the top panel 16 and is in contact with the passive component 32 of the link device 30. The strain device 40 comprises a first roller 41 and a second roller 42. The first roller 41 is installed onto the internal side of the foregoing synchronous belt and the second roller 42 is installed onto the external side of the synchronous belt. When the strain device 40 is in use, the synchronous belt is pressed against the gear effectively without any error produced by the gap between the gears to assure the synchronous rotation of the two control members 20.

Figure 3:
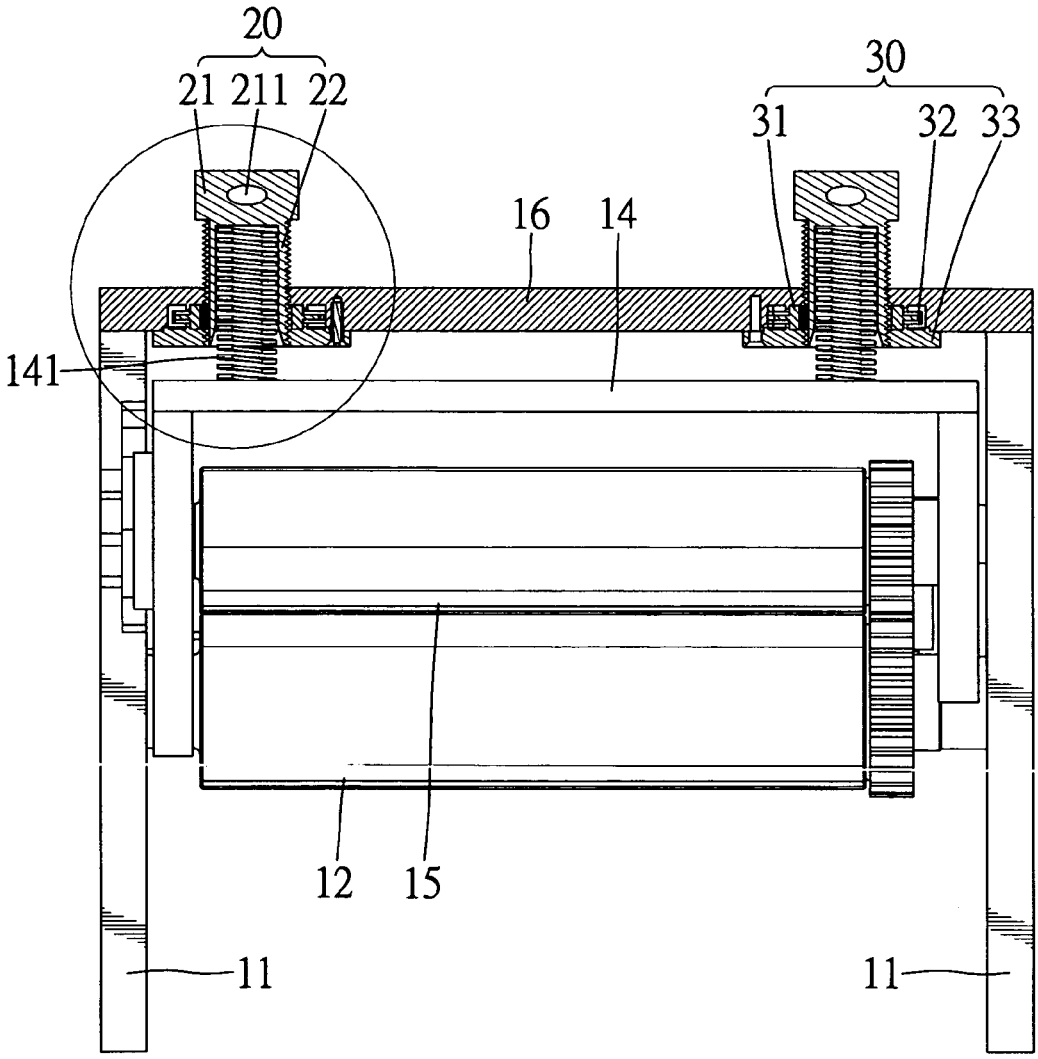
FIG. 3 is a cross-sectional view of section 3—3 as depicted in FIG. 2.

Referring to FIG. 3, the control member 20 is connected with the movable stand 14 by the spring 141, such that the spring 141 of the movable stand 14 can push the movable roller 15 to be in contact with the fixed roller 12 for the material feeding operation. During the process of feeding materials, it is necessary to make adjustments according to the actual conditions since the thickness of materials may vary. Therefore, the gap between the movable roller 15 and the fixed roller 12 can be adjusted to cope with the change to the thickness of materials. If the movable roller 15 can maintain an even force exerted on the fixed roller 12, it only needs to rotate one control member 20, with the other control member 20 driven by the link device 30 to produce a synchronous rotation.

The link device 30 according to the present invention is installed onto the internal side of the top panel 16. The link device 30 can produce a synchronous movement for both ends of the movable roller 15. When one control member 20 is adjusted, the other control member 20 is linked as well. The control members 20 utilize the spiral movement of the threaded end 22 for fine tuning a slight axial gain in order to achieve the function of synchronously fine tuning the movable roller 15 to press down.

Figure 4:
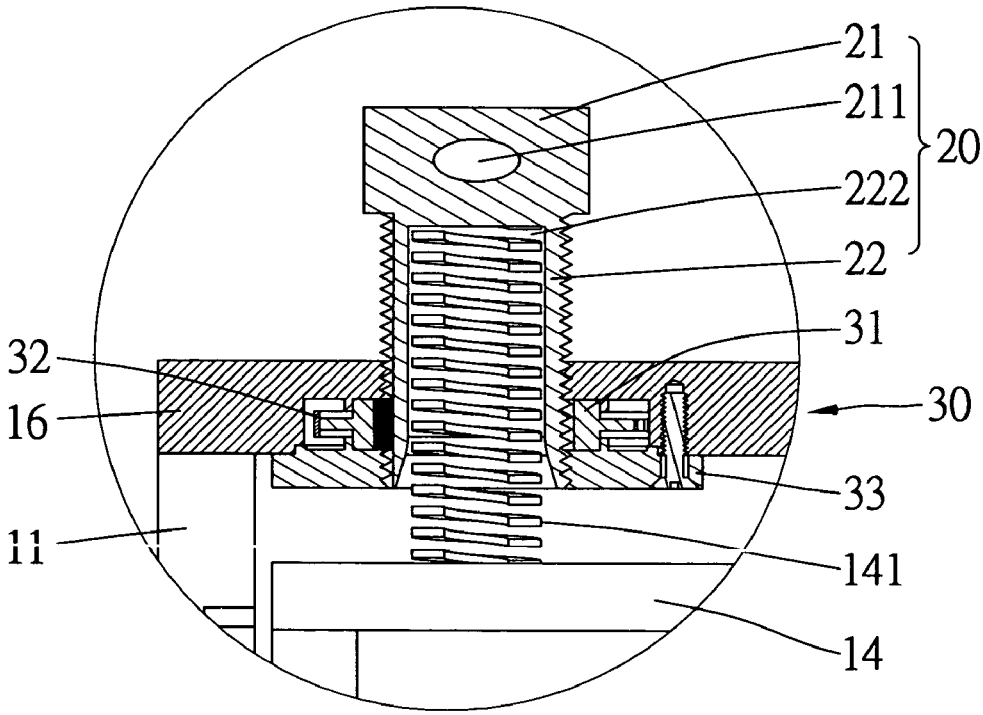
FIG. 4 is an enlarged cross-sectional view of a part of FIG. 3.

Referring to FIGS. 3 and 4 and if it is necessary to synchronously fine tune the movable roller 15, one control member 20 drives its adjusting end 21 to rotate, so that the control member 20 drives the gear on the same end to rotate. By the link of the synchronous belt to another end of the gear, the other control member 20 is driven to produce a synchronous rotation as to produce an effect of synchronously elastically pushing the movable roller 15.

Figure 5:
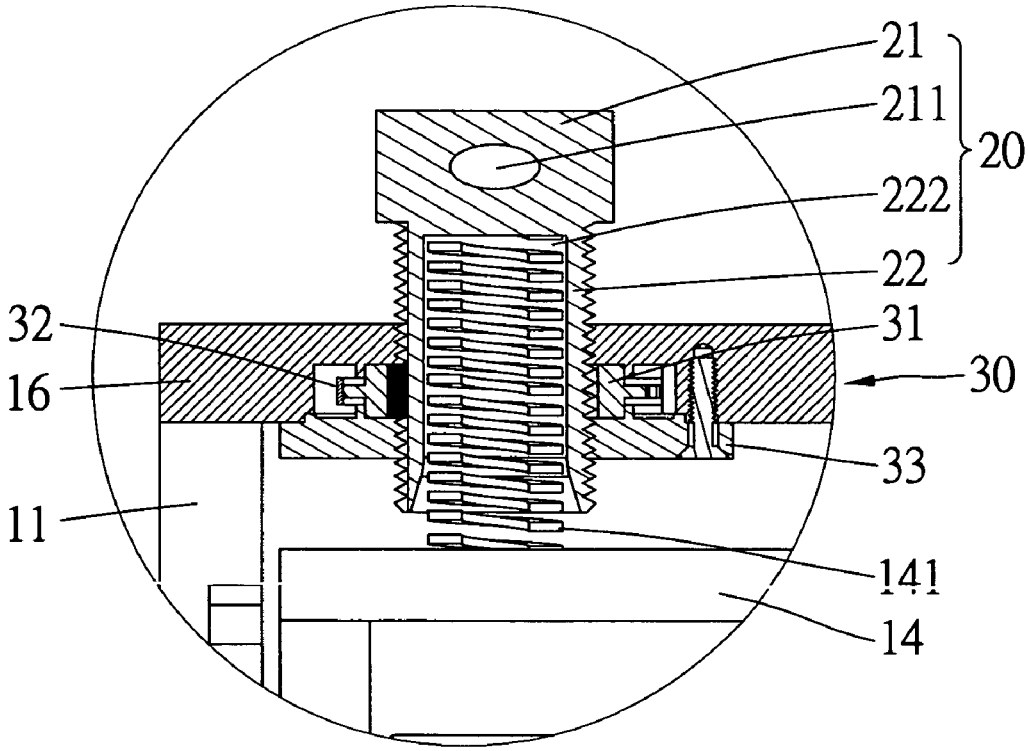
FIG. 5 is an illustrative view of the movement of the fine tuning the control member as depicted in FIG. 3 according to the present invention.

Referring to FIGS. 3 and 5 and after the control member 20 is rotated, the spring 141 is compressed to push the movable stand 14. The movable stand 14 is pushed synchronously by the springs 141 on both sides, so that both ends of the movable roller 15 produce the same forces and the movable roller 15 will not incline to one side. A simple operation can keep an even force at the contact surface between the movable roller 15 and the fixed roller 12, so that the clamped material can be fed smoothly. Thus, the present invention is a novel useful design.

Figure 6:
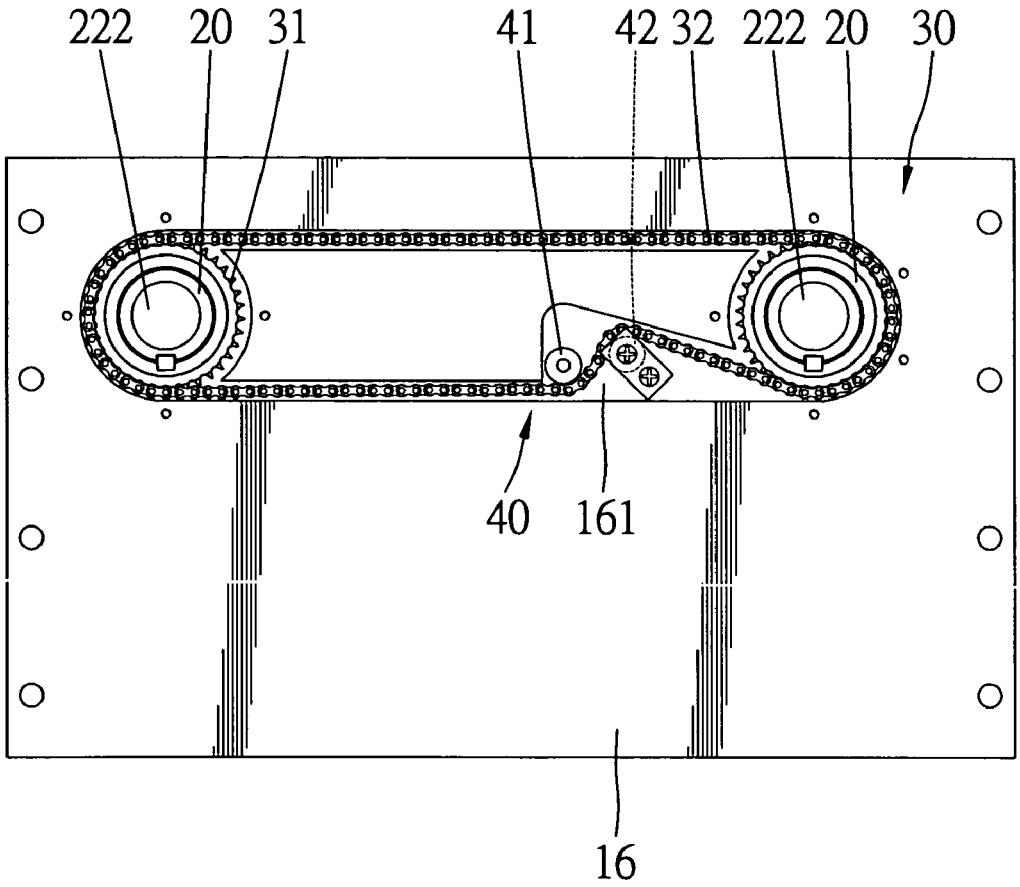
FIG. 6 is an illustrative view of the link device using a gear wheel and a chain to generate the synchronization according to a second preferred embodiment the present invention.

Please refer to FIG. 6 for the synchronous fine tunable material feeding mechanism according to a second preferred embodiment of the present invention. The link device 30 collocating with a gear wheel and a chain also gives an excellent effect on the synchronization. This embodiment can install a strain device 40 at the chain, so that the chain can press on the two gear wheels to prevent any asynchronous movement caused by the error of the gap and assure the fine-tuned synchronous movement.

Figure 7:
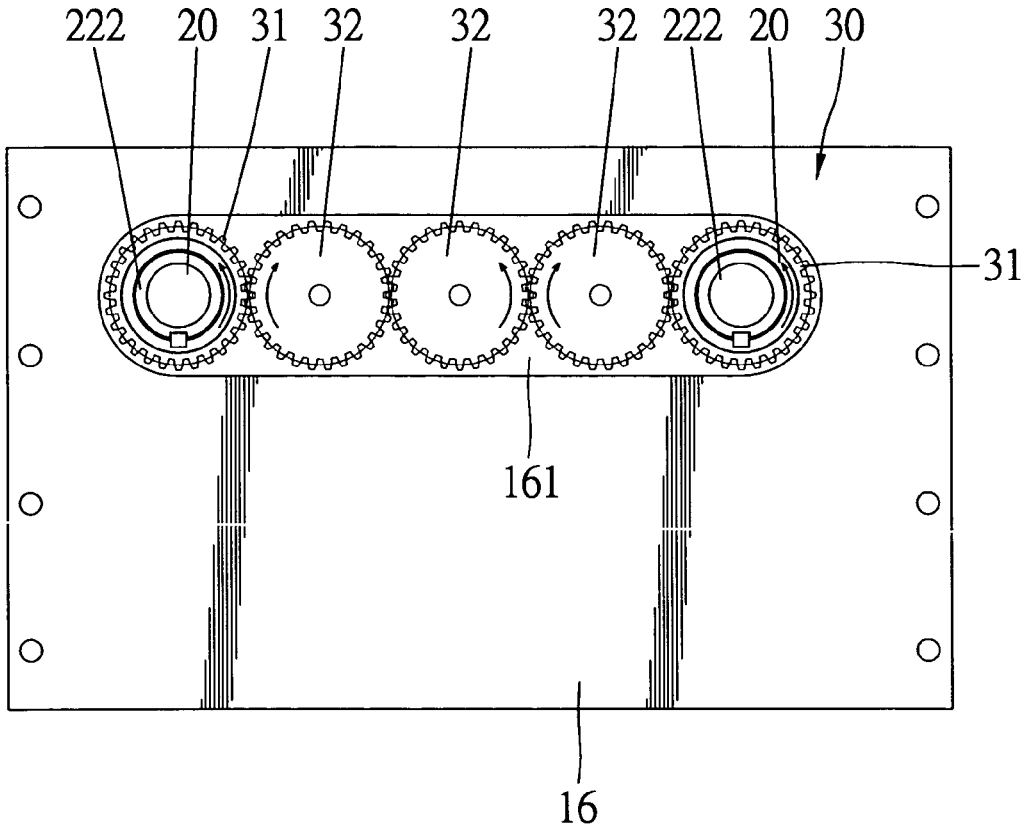
FIG. 7 is an illustrative view of the link device using a plurality of gears to generate the synchronization according to a third preferred embodiment the present invention.

Please refer to FIG. 7 for the synchronous fine tunable material feeding mechanism according to a third preferred embodiment of the present invention. The active component 31 of the link device 30 is a gear, and the passive component 32 comprises a plurality of gears coupled between the active components 31. When the present invention is adopted in a production process, different sizes and quantities of gears are engaged with each other according to the distance between the two active components 31 to produce a good synchronization effect. The present invention can utilize a different link device 30 to produce the fine-tune synchronization effect and, thus, is a novel useful design.

In summation of the above description, the present invention herein enhances the performance over that of the conventional structure.

While the invention has been described by way of examples and in terms of preferred embodiments, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A synchronous fine tunable feeding mechanism comprising:

a platform including a first side panel, a second side panel, a top panel disposed on said first and second side panels, a fixed roller pivotally coupled between said first and second side panels and a movable roller contacting said fixed roller;

two control members being disposed at said top panel and elastically pushing against said movable roller; and a link device being disposed between said two control members for simultaneously driving one of said control members according to the movement of another one of said control members to synchronize said two control members to elastically push said movable roller;

wherein said movable roller maintains a constant pressure with respect to said fixed roller as to exert an even force onto a work piece clamped by contact surfaces of said movable roller and said fixed roller, wherein said link device comprises two active components, a passive component and two bases, and said two active components are coupled to said two control members respectively and said passive component is coupled between said two active components for generating a synchronous movement, and said two bases are secured on one side of said top panel for fixing said two active components at appropriate positions.

2. The synchronous fine tunable feeding mechanism of claim 1 further comprising a movable stand pivotally disposed between said two side panels for producing a swinging movement with respect to said side panels, wherein said movable stand installs said movable roller therein.

3. The synchronous fine tunable feeding mechanism of claim 2, wherein said control members each comprise a spring and are separately disposed at both ends on one side of said movable stand.

4. The synchronous fine tunable feeding mechanism of claim 1, wherein said top panel comprises an accommodating space on one side for installing said link device.

5. The synchronous fine tunable feeding mechanism of claim 4, wherein said accommodating space includes a through hole on each of both ends for passage of said control members.

6. The synchronous fine tunable feeding mechanism of claim 5, wherein said through hole comprises a thread therein for threadably receiving said control member.

7. The synchronous fine tunable feeding mechanism of claim 1, wherein each said control member has an adjusting end for allowing a user to operate said control member.

8. The synchronous fine tunable feeding mechanism of claim 7, wherein said adjusting end has a penetrating hole for allowing a user to use a tool to pull said control member.

9. The synchronous fine tunable feeding mechanism of claims 2 or 7, wherein said control member has a threaded end for threadably passing through said top panel and producing a spiral movement.

10. The synchronous fine tunable feeding mechanism of claim 9, wherein said threaded end comprises a groove disposed at the external periphery of said threaded end and parallel to an axis for installing a key to drive the operation of said link device.

11. The synchronous fine tunable feeding mechanism of claim 10, wherein said threaded end comprises a hollow sink hole therein for accommodating a spring to push said movable stand.

12. The synchronous fine tunable feeding mechanism of claim 1, wherein said active component is a gear and said passive component is a synchronous belt.

13. The synchronous fine tunable feeding mechanism of claim 1, wherein said active component is a gear wheel and said passive component is a chain.

14. The synchronous fine tunable feeding mechanism of claim 1, wherein said active component is a gear and said passive component comprises a plurality of gears.

15. The synchronous fine tunable feeding mechanism of claim 1, wherein said passive component of said link device further installs a strain device for pressing said passive components against said active component.

* * * * *